US009837726B2

(12) United States Patent
Sharawi et al.

(10) Patent No.: US 9,837,726 B2
(45) Date of Patent: Dec. 5, 2017

(54) MULTI-BAND ACTIVE INTEGRATED MIMO ANTENNAS

(71) Applicant: KING FAHD UNIVERSITY OF PETROLEUM AND MINERALS, Dhahran (SA)

(72) Inventors: Mohammad S. Sharawi, Dhahran (SA); Sagar K. Dhar, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 686 days.

(21) Appl. No.: 14/325,318

(22) Filed: Jul. 7, 2014

(65) Prior Publication Data

US 2016/0006116 A1 Jan. 7, 2016

(51) Int. Cl.

| | |
|---|---|
| ***H01Q 21/00*** | (2006.01) |
| ***H01Q 9/04*** | (2006.01) |
| ***H01Q 23/00*** | (2006.01) |
| *H01Q 1/24* | (2006.01) |

(52) U.S. Cl.

CPC ..... *H01Q 21/0006* (2013.01); *H01Q 9/0421* (2013.01); *H01Q 23/00* (2013.01); *H01Q 1/243* (2013.01)

(58) Field of Classification Search

CPC .. H01Q 21/0006; H01Q 9/0421; H01Q 23/00; H01Q 1/38; H01Q 9/0407; H01Q 1/243; H01Q 5/0003

See application file for complete search history.

(56) References Cited

U.S. PATENT DOCUMENTS

| | | | | |
|---|---|---|---|---|
| 8,421,686 | B2 | 4/2013 | Soler Castany et al. | |
| 2011/0098033 | A1* | 4/2011 | Britz | H01Q 3/44 455/422.1 |
| 2011/0188552 | A1* | 8/2011 | Yoon | H04B 1/38 375/219 |
| 2012/0026058 | A1* | 2/2012 | Illera | H01Q 1/36 343/848 |

(Continued)

OTHER PUBLICATIONS

Khan et al., "A compact 8-element MIMO antenna system for 802.11ac WLAN applications," 2013 International Workshop on Antenna Technology (iWAT), pp. 91-94, Karlsruhe, Germany, Mar. 4-6, 2013.

(Continued)

*Primary Examiner* — Jessica Han
*Assistant Examiner* — Jae Kim
(74) *Attorney, Agent, or Firm* — Oblon, McClelland, Maier & Neustadt, L.L.P.

(57) ABSTRACT

The multi-band active integrated MIMO antenna is a planar structure that includes active devices such as power amplifiers (PA) for transmit modes, as well as low-noise-amplifiers (LNA) for receive modes or complete transceivers (both PA and LNA for bi-directional operation, i.e. transmit and receive modes simultaneously). The antenna provides active loading to facilitate a diversity advantage expected from 4G and 5G wireless systems. The integrated active amplifier device within the antenna increases system throughput while supporting multi-band operation for multi-wireless standards. Moreover, integration with the radio frequency front end eases matching while providing higher gain.

5 Claims, 12 Drawing Sheets

(56) References Cited

U.S. PATENT DOCUMENTS

| | | | | |
|---|---|---|---|---|
| 2012/0139793 | A1 | 6/2012 | Sharawi | |
| 2013/0234896 | A1 | 9/2013 | Sharawi et al. | |
| 2013/0314765 | A1* | 11/2013 | Padilla | G01K 7/003 359/315 |

OTHER PUBLICATIONS

Sharawi et al., "Four-shaped 2 3 2 multi-standard compact multiple-input—multiple-output antenna system for long-term evolution mobile handsets," IET Microwaves, Antennas & Propagation, vol. 6, Issue 6, pp. 685-696, Apr. 24, 2012.

* cited by examiner

MULTI-BAND ACTIVE INTEGRATED MIMO ANTENNAS

BACKGROUND OF THE INVENTION

1. Field of the Invention

The present invention relates to multi-band wireless electronics, and particularly to a printed multi-band active integrated MIMO antenna directly connected to active transceivers containing both transmit and receive amplifiers 2. Description of the Related Art Multiband antennas are currently widely used in all types of wireless handheld devices, from cell phones, to tablet PCs and laptops. Such antennas can support multiple standards, and are usually compact and conformal to the device shape and size. The use of multiple antennas within the user handheld devices is becoming a necessity in fourth generation (4G) and fifth generation (5G) wireless terminals as they provide much higher data rates that are required for high speed and multimedia data transfers that we all enjoy nowadays. The use of multiple antennas is required within the multiple-input-multiple-output (MIMO) system architecture that utilizes the once very undesirable multipath phenomena in single antenna devices to its advantage in increasing the data throughput.

Active integrated antennas (AIA) refer to antennas intimately integrated with active devices including the DC bias network without any isolator or circulator. There is no boundary or separable point between active circuits and the antenna in an AIA and both of them are designed as a whole unit. So, neither the antenna nor the active circuits need to be designed for 50Ω except at the AIA input/output port. AIAs have very desirable features such as, increasing the effective length for short antennas (antenna miniaturization), increasing the bandwidth, decreasing the mutual coupling between adjacent array elements, improving the noise factors, and improving the gain of the antenna.

Thus, multi-band active integrated MIMO antennas solving the aforementioned problems are desired.

SUMMARY OF THE INVENTION

The multi-band active integrated MIMO antenna is a planar structure that includes active devices such as power amplifiers (PA) for transmit modes, as well as low-noise-amplifiers (LNA) for receive modes or complete transceivers (both PA and LNA for bi-directional operation, i.e. transmit and receive modes simultaneously). The antenna provides active loading to facilitate a diversity advantage expected from 4G and 5G wireless systems. The integrated active amplifier device within the antenna increases system throughput while supporting multi-band operation for multi-wireless standards. Moreover, integration with the radio frequency front end eases matching while providing higher gain. Thus the present multi-band active integrated MIMO antenna is a miniaturized active integrated antenna (AIA) providing a basic radiating element for multiband MIMO based handheld devices having simultaneous transmit and receive capabilities.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
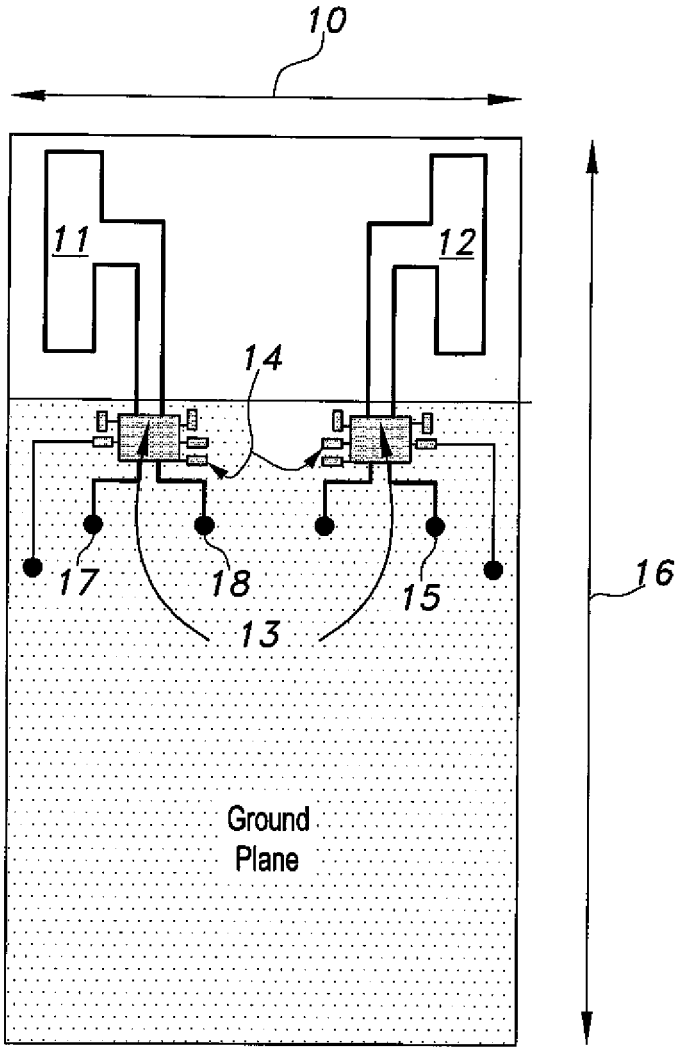
FIG. 1 is a diagrammatic plan view of an exemplary multi-band active integrated MIMO antenna according to the present invention.

An exemplary multi-band active integrated (MAI) multiple-input and multiple-output (MIMO) antenna system with active components is shown in FIG. 1. In this configuration, two printed based multi-band antennas 11, 12, are directly connected to the active elements 13 that represent active transceivers containing both transmit and receive amplifiers. The biasing component 15 and the matching component 14 for both transceivers are included to provide proper operation at the bands of interest. Each MAI antenna has an output for the receive path 17, and an output for the transmit path 18. These two input/output connections are to be connected to other components in the transmit/receive chains of the wireless system. The MIMO configuration is created by using the two antennas 11 and 12, along with their active elements 13, simultaneously. The system backplane or mobile terminal substrate dimensions are a predetermined width 10, and a predetermined length 16.

There are various types of AIA, specifically, oscillator type, PA type, LNA type, mixer type and transceiver types. The PA, LNA and transceiver types are within contemplation of the present invention, although the same concepts can be extended to other types easily with careful design of the active circuits. Additionally, the present invention can be applied to any type of printed antennas.

Figure 2:
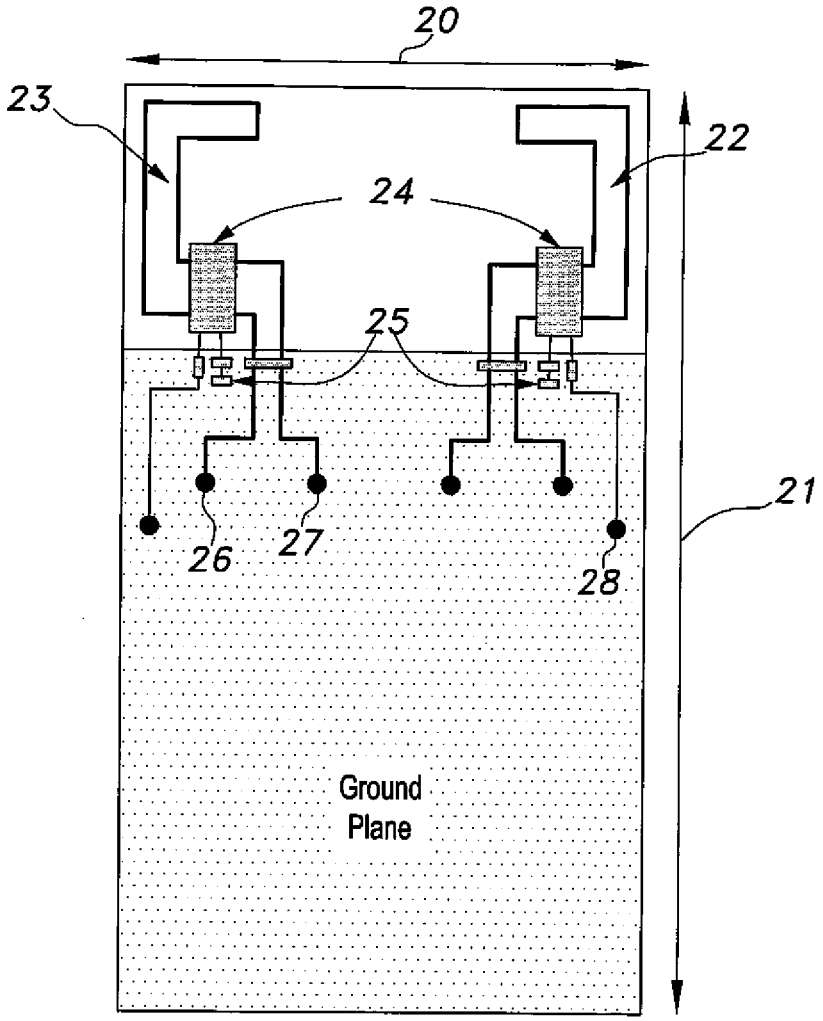
FIG. 2 is a diagrammatic plan view of an exemplary multi-band active integrated MIMO antenna showing placement of the bias and matching circuits according to the present invention.

In the embodiment shown in FIG. 2, the dual element MAI-MIMO antenna is placed on a mobile terminal substrate having a top face, a bottom face, and dimensioned to a predetermined width 20, and a predetermined length 21. A ground plane is disposed on the bottom face of the substrate below the multi-band antenna elements 22 and 23 to create a ground plane layer. The transceivers 24 are placed within the antenna structure for seamless integration and actual loading of the circuits of transceivers 24 by the antennas 22 and 23. The bias circuits 25 and matching circuits 28 are placed above the ground plane layer. Each antenna has an input 26 and an output 27 that are respectively connected to the transmit and receive parts of the MIMO antenna system.

Figure 3:
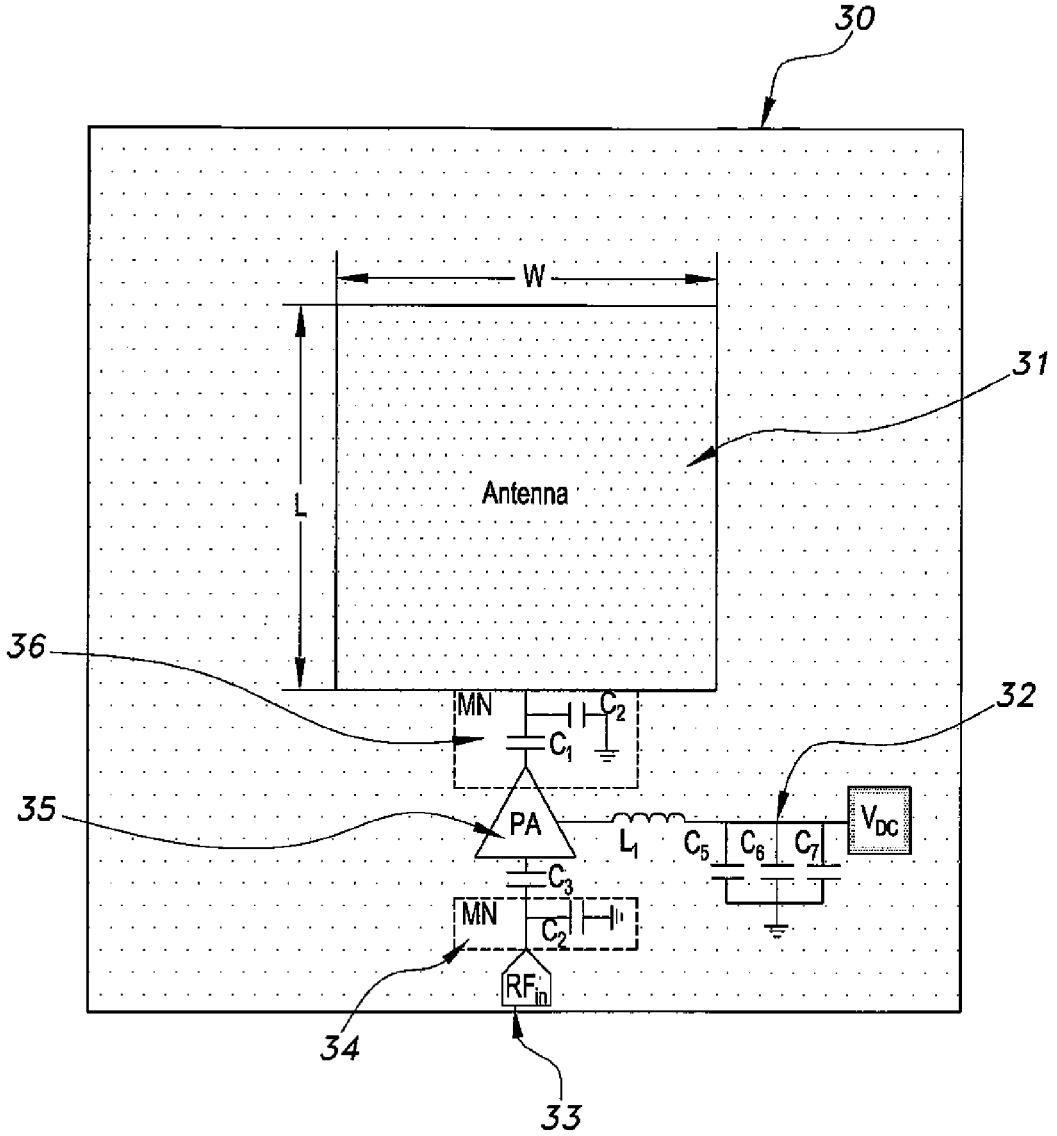
FIG. 3 is a top plan view of an exemplary microstrip patch multi-band active integrated MIMO antenna showing the active and passive component configuration according to the present invention.

In a more detailed description of the MAI structure, FIG. 3 shows a complete transmit path connected to a microstrip patch antenna 31. The complete single element MAI antenna is placed on a substrate 30, the single input 33 of the system feeds the first matching circuit 34. The first matching circuit 34 directly connects the transmitter output to the power amplifier 35. The required biasing of the power amplifier is achieved via a biasing network 32 comprised of a series of capacitors and an RF choke inductor. The output of the power amplifier 35 is fed to a multi-band matching network 36 that tracks and matches the variation of the input impedance of the microstrip antenna at various frequencies. This way, multi band active integrated antenna behavior is achieved with good efficiency and matching conditions.

Figure 4A:
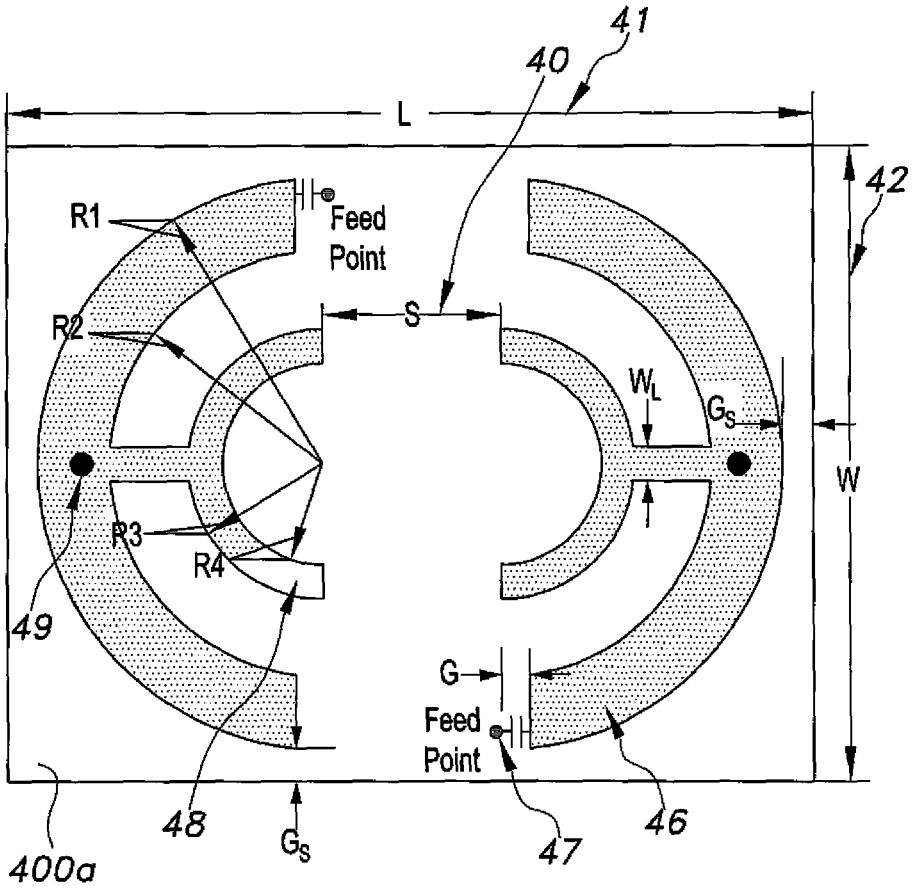
FIG. 4A is a top plan view of a semi-circular array of the multi-band active integrated MIMO antennas according to the present invention.
Figure 4B:
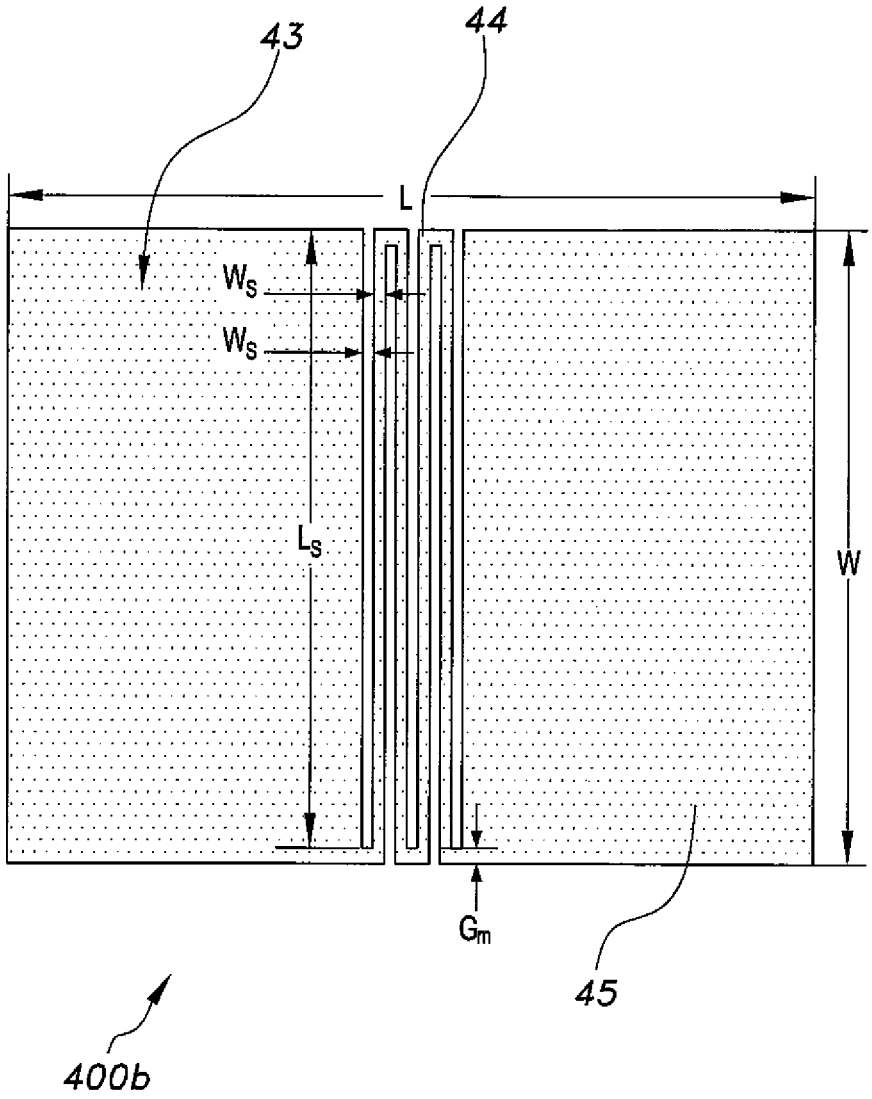
FIG. 4B is a bottom plan view showing a ground plane of the semi-circular array of the multi-band active integrated MIMO antennas according to the present invention.

Since a MIMO antenna system requires multiple antenna structures, and since for wireless handheld devices space is limited, especially in cellular phones and pocket sized handheld devices, compact antenna structures are desirable. However, placing antennas close to each other increases coupling, reduces efficiencies, and degrades the MIMO system performance though high channel correlations. That is why the present invention also contemplates providing a new multi-band MIMO antenna structure based on a semi-circular antenna array comprised of first semi-ring antenna element 46 and connected second semi-ring antenna element 48 printed on a top side 400*a* of the substrate, as shown in FIG. 4A. The ground plane side is shown in FIG. 4B. As shown in FIG. 4A, two identical dual semi-ring antennas 46 are disposed within a minimum distance S 40 of each other on a substantially rectangular shaped substrate 400*a* having a predetermined length (L) 41 and a predetermined width (W) 42, for MIMO operation. The feed point 47 on the outer ring is tuned to provide the necessary input matching at one band while the inner semi-ring 48 is used to tune the other band. A shorting post 49 in radial alignment with the connection of the first semi-ring antenna element to the second semi-ring antenna element and extending from the antenna surface 400*a* to the bottom ground plane 400*b* is used to excite the second band of operation. A defected ground meandering rectangular wave patterned structure 44 is disposed between and connects two unbroken rectangular ground planes 43 and 45 to enhance the isolation between the two adjacent antennas 46. Feeding the semi-ring multi-band antenna from either edge side will provide the same effect.

Figure 5:
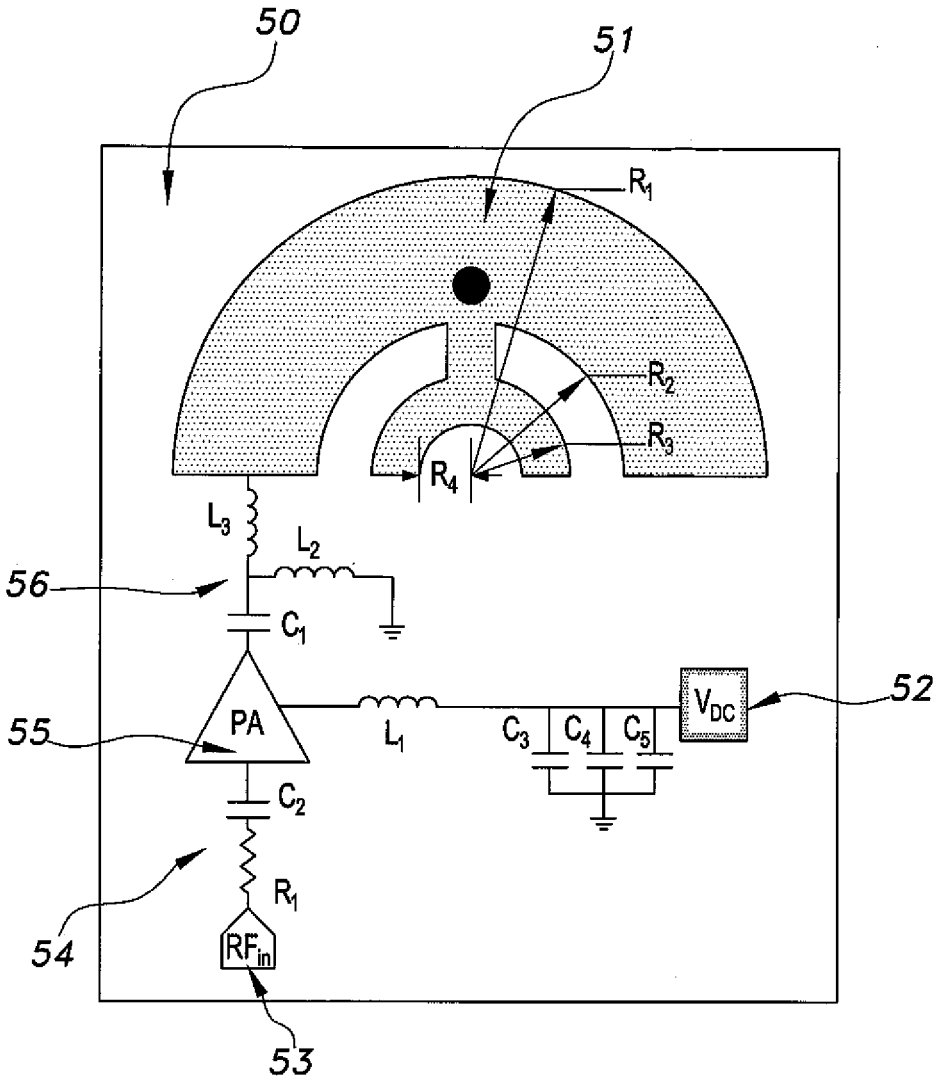
FIG. 5 is a diagrammatic top plan view of the semi-circular array showing placement of the active and passive components utilizing a single PA according to the present invention.

FIG. 5 shows a configuration of the MAI antenna based on the aforementioned semi-ring antenna. The antenna 51 is placed on a top face of substrate 50. a ground plane is disposed on a bottom face of substrate 50. The input 53 of this transmit type configuration connects directly to the input matching network 54 which connects to the power amplifier 55. The amplifier is biased via a biasing network 52, and the output of the amplifier feeds a multi-band matching network 56 that directly feeds the antenna 51. Note that the multi-band feeding network is not matching the antenna to have 50 ohms, but rather is used to deal with any arbitrary complex input impedance of the antenna.

Figure 6:
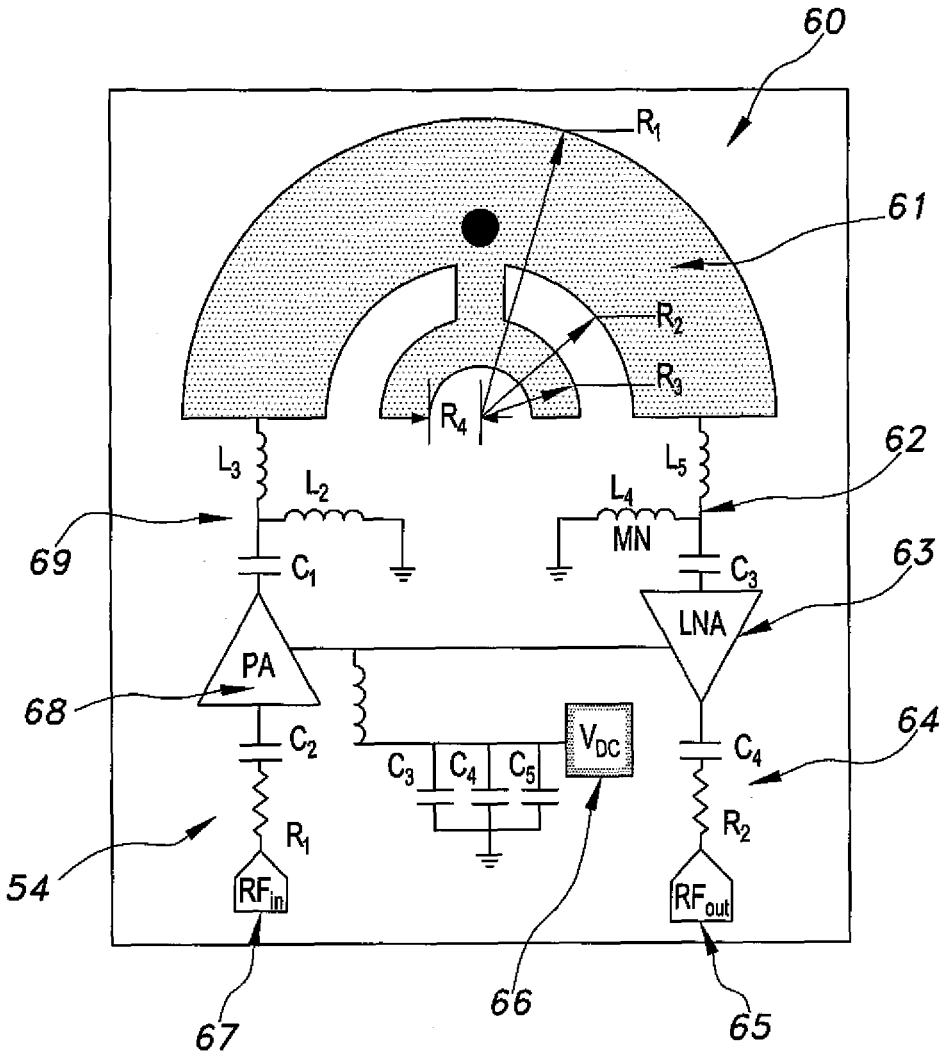
FIG. 6 is a diagrammatic top plan view of the semi-circular array showing placement of the active and passive components utilizing a single PA and a single LNA configured at opposing ends of the semi-circular array according to the present invention.

To provide embedded isolation between the transmit and receive paths, another configuration, as shown in FIG. 6, includes input of the transmit path 67 feeding the power amplifier 68 via input matching network 54. The output signal from PA 68 passes through the multi-band matching network 69 to the antenna 61. The received signal comes from the other symmetric portion of the semi-ring antenna 61, and passes through the multi-band receiving matching network 62, to a low noise amplifier 63 and then through the output matching network 64 to a receiving node 65. Both amplifiers are biased via a biasing network 66, and are placed on the same substrate 60.

Figure 7:
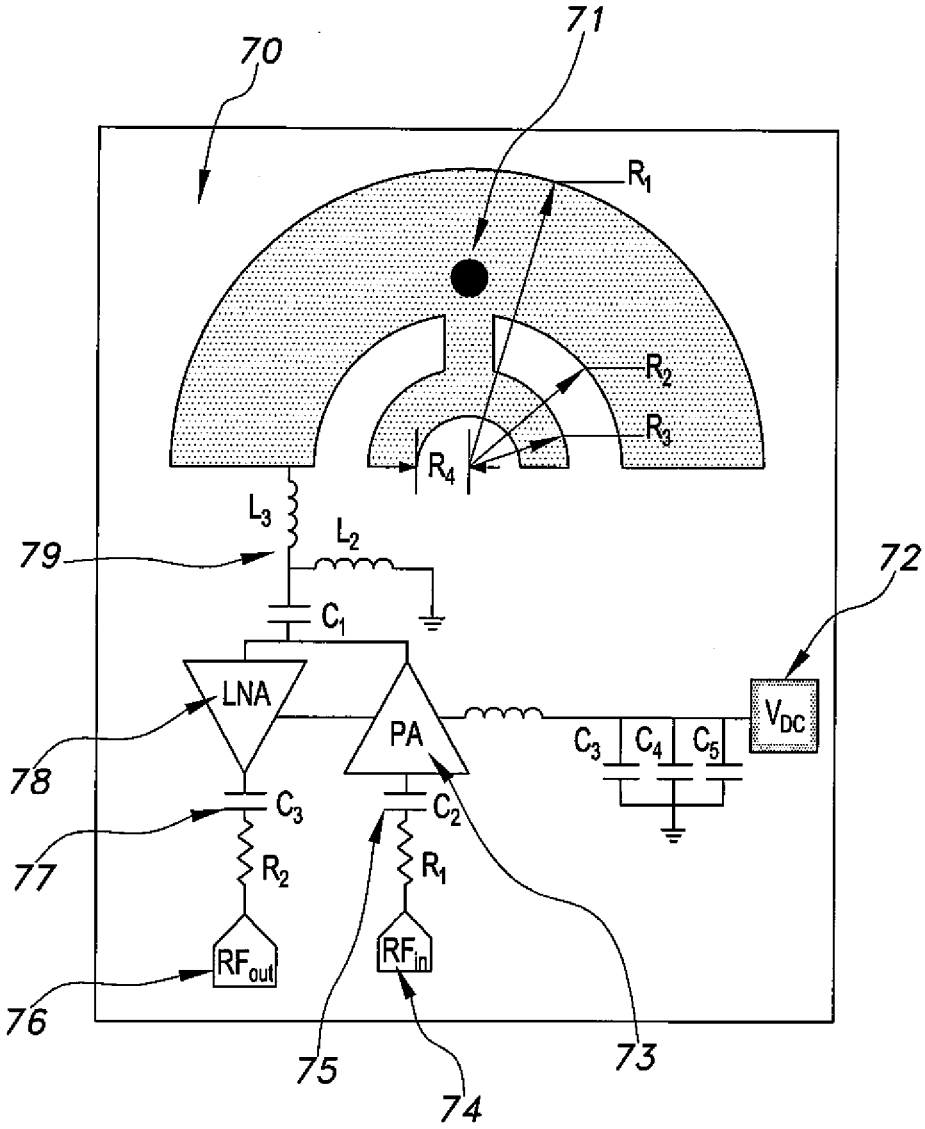
FIG. 7 is a diagrammatic top plan view of the semi-circular array showing placement of the active and passive components utilizing a single PA and a single LNA configured at the same end of the semi-circular array according to the present invention.

In yet another configuration using the semi-ring multi-band antenna 71, as shown in FIG. 7, the input terminal 74 and output terminal 76 are connected to the input and output matching networks 75 and 77, respectively. The LNA 78 and the PA 73 are biased using biasing network 72. The amplifiers 78 and 73 are connected to a multi-band network 79 that provides isolation between the two paths and connects to the antenna at one end. A common substrate 70 is used for this microstrip design.

Figure 8:
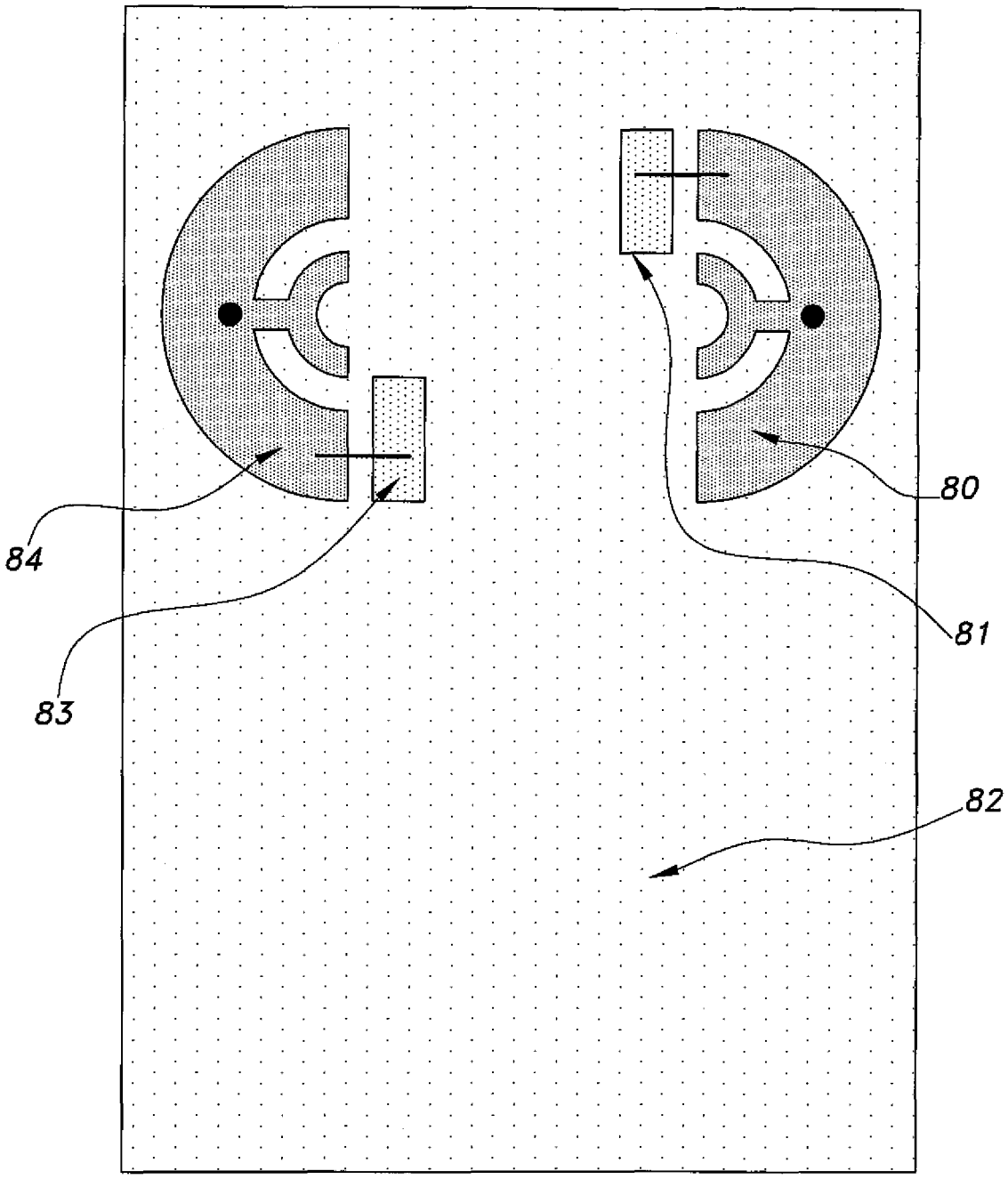
FIG. 8 is a top plan view of a two element semi-circular array of the multi-band active integrated MIMO antennas according to the present invention.

FIG. 8 shows an embodiment of the MAI-MIMO antenna system on a wireless handset backplane 82. The two identical multi-band MIMO antennas 84 and 80 are connected to their respective active circuits 83 and 81 via one of the aforementioned configurations.

Figure 9:
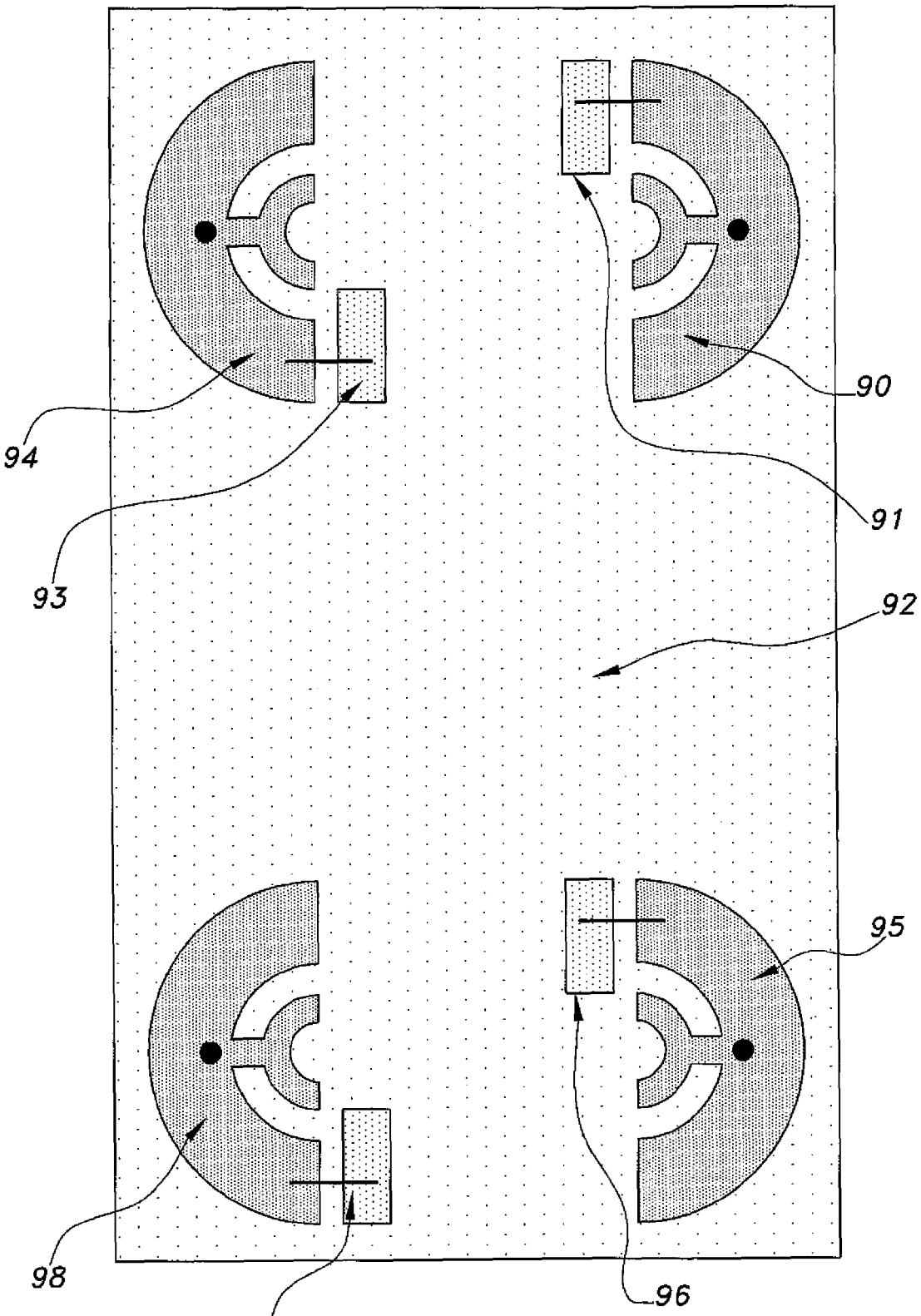
FIG. 9 is a top plan view of a four element semi-circular array of the multi-band active integrated MIMO antennas according to the present invention.

Another configuration would be to have a 4-element MAI-MIMO antenna system, as shown in FIG. 9, where four identical (or dissimilar) multi-band antennas 94, 98, 95, 90, are connected to their respective active sections 93, 97, 96, 91, using one of the aforementioned configurations for transmit and receive or transceiver structures, and all share the same substrate 92.

Figure 10:
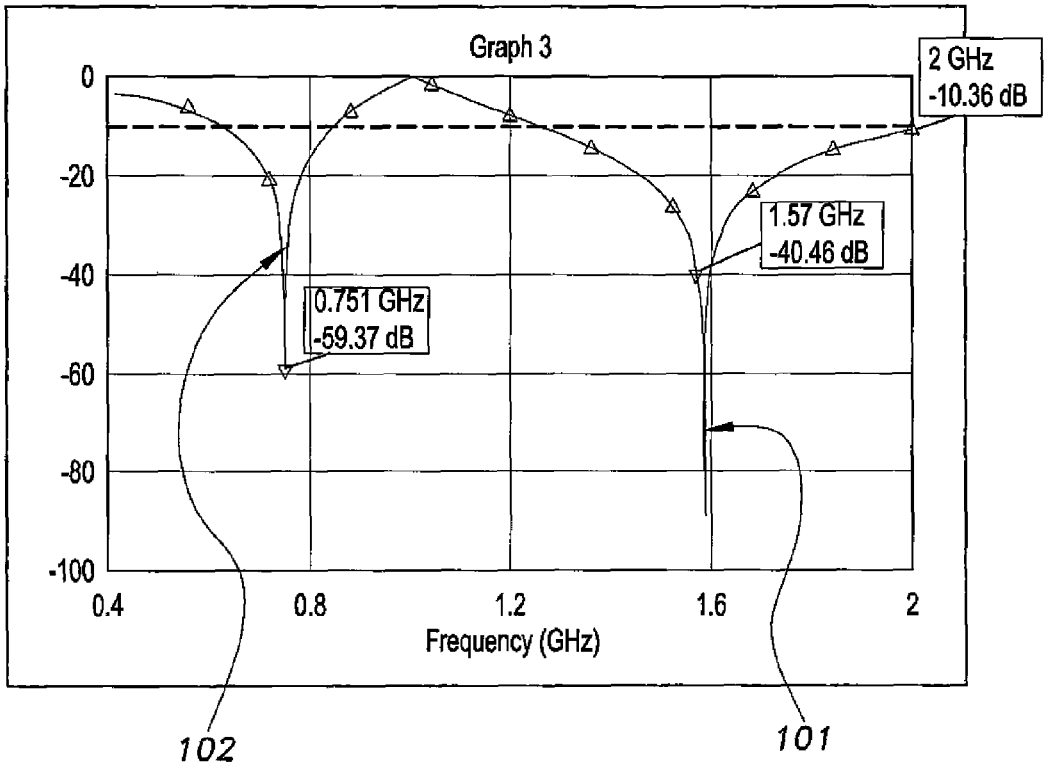
FIG. 10 is a plot showing frequency response of the multi-band active integrated MIMO antenna according to the present invention.
Figure 11A:
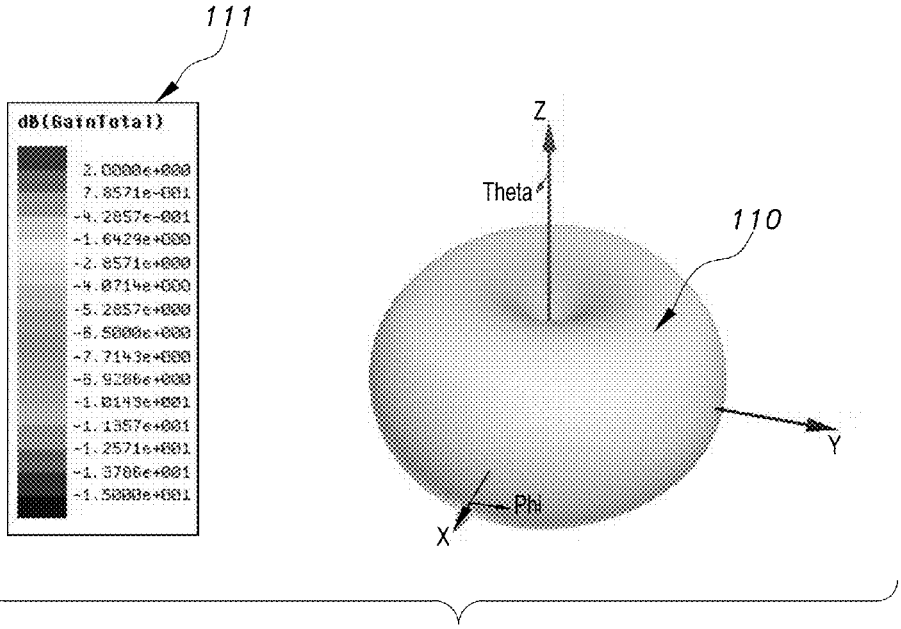
FIG. 11A is a plot showing gain response of the higher band antenna of the multi-band active integrated MIMO antenna according to the present invention.
Figure 11B:
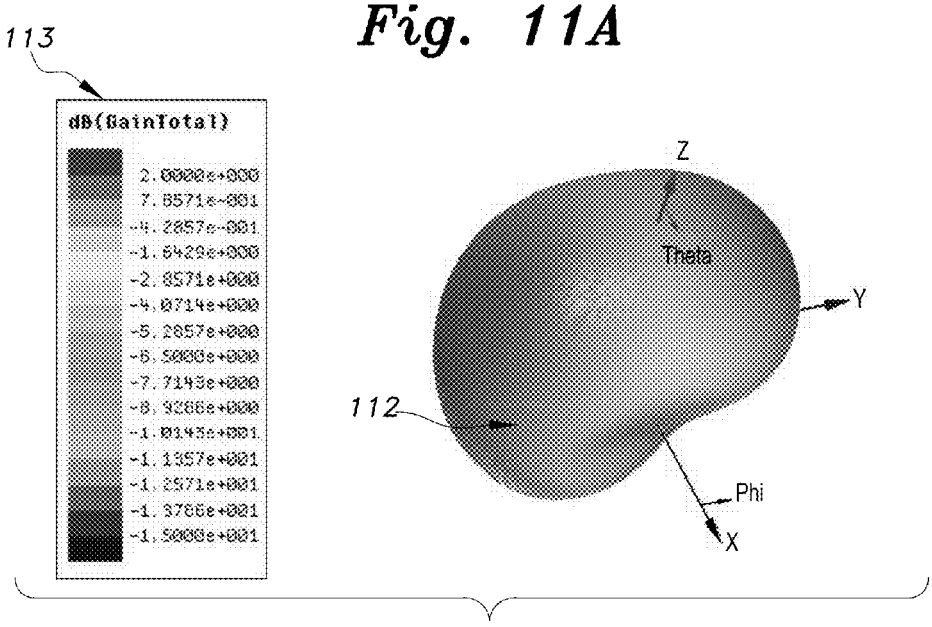
FIG. 11B is a plot showing gain of the lower band antenna of the multi-band active integrated MIMO antennas according to the present invention.

Multi-band operation from a MAI-antenna is shown in the plot of FIG. 10. The first band is resonating at 750 MHz (plot line 102) with a wide bandwidth, and the other band (plot line 101) is resonating at 1.57 GHz with a wide bandwidth. Several variations can be obtained here, and several bands other than those shown can be covered. This exemplary configuration shows the multi-band effectiveness of the multi-band active integrated MIMO antenna. Sample radiation gain patterns at the two center bands of operations are shown in FIGS. 11A and 11B. The lower band has an omnidirectional gain pattern 110 with a maximum gain 111 of approximately −1 dB (this value can change based on the antenna type used, and is shown here for the semi-ring antenna without active loading). The gain pattern 112 at the higher band shows a maximum gain 113 of 2 dB (this value can also be changed and does not show the effect of the power amplifier in the transmit chain).

The present multi-band active integrated MIMO antenna also covers any other multi-band printed antenna variation in a MIMO configuration as well as any kind of active element loading or direct integration between active elements and multi-band antennas with multi-band matching and feeding networks.

It is to be understood that the present invention is not limited to the embodiments described above, but encompasses any and all embodiments within the scope of the following claims.

We claim:

1. A multi-band active integrated (MAI) MIMO antenna, comprising:

a planar substrate which includes a top face and a bottom face;

at least one multi-band antenna printed in a multiple input, multiple output (MIMO) configuration on the top face of the planar substrate, wherein said at least one multi-band antenna is a semi-circular array comprising a first semi-ring antenna element connected on the top face of the planar substrate to a second semi-ring antenna element, the first and second semi-ring antenna elements being connected to one another at respective midpoints thereof, each of the first and second semi-ring antenna elements having a semi-circular contour and being positioned concentrically with respect to one another;

at least one bottom around plane disposed on the bottom face directly below the at least one multi-band antenna;

a tunable feedpoint disposed at an end of an outer one of said first and second semi-ring antenna elements;

a shorting post aligned with the midpoints of said first semi-ring antenna element and said second semi-ring antenna element, the shorting post extending from a surface of the at least one multi-band antenna to the bottom ground plane, thereby exciting a second band of operation of said MAI MIMO antenna;

at least one active element operably connected to the at least one printed multi-band antenna and loading the at least one printed multi-band antenna, the at least one active element, being disposed on the top face of the planar substrate and proximate to the at least one printed multi-band antenna; and a biasing network connected to the at least one active element, the biasing network being disposed on the top face of the planar substrate.

2. The multi-band active integrated MIMO antenna according to claim 1, further comprising a defected ground meandering rectangular wave patterned structure disposed between and connecting a first of said at least one ground plane to a second of said at least one ground plane.

3. The multi-band active integrated MIMO antenna according to claim 1, wherein the substrate is a mobile terminal substrate.

4. The multi-band active integrated MIMO antenna according to claim 1, wherein pairs of the at least one multi-band antenna are disposed in alignment facing each other on opposing sides of the top face of the planar substrate.

5. The multi-band active integrated MIMO antenna according to claim 4, wherein pairs of said at least one active element corresponding to said at least one multi-band antenna pairs are misaligned with each other on opposing sides of the top face of the planar substrate.

* * * * *